United States Patent [19]

Sauer

[11] 4,317,318

[45] Mar. 2, 1982

[54] SUPPORTING GRID SYSTEM HAVING INTERCHANGEABLE T SECTIONS

[75] Inventor: Gale E. Sauer, Williamsville, N.Y.

[73] Assignee: Roblin Industries, Inc., Buffalo, N.Y.

[21] Appl. No.: 71,869

[22] Filed: Sep. 4, 1979

[51] Int. Cl.[3] ..... F16B 7/22

[52] U.S. Cl. ..... 52/667; 52/726

[58] Field of Search ..... 52/144, 664, 666, 726, 52/484, 667; 403/364, 393

[56] References Cited

U.S. PATENT DOCUMENTS

| | | | |
|---|---|---|---|
| 3,221,466 | 12/1965 | Downing | 52/726 |
| 3,922,829 | 12/1975 | Sauer | 52/667 |
| 4,161,856 | 7/1979 | Brown | 52/667 |

*Primary Examiner*—John E. Murtagh

*Attorney, Agent, or Firm*—Christel, Bean & Linihan

[57] ABSTRACT

A one piece T section used interchangeably as both a main T member and a cross T member in a supporting grid system for suspended ceilings. The interchangeable T sections have locking connectors engageable to interlock a pair of sections in end to end relation to form a main T splice with their tile supporting flanges substantially abutting. When the sections are used as cross T members, the locking connectors engage the web of a section used as a main T member and the flanges of the cross T sections overlie the flanges of the main T section with which they are interlocked.

4 Claims, 6 Drawing Figures

SUPPORTING GRID SYSTEM HAVING INTERCHANGEABLE T SECTIONS

BACKGROUND OF THE INVENTION

This invention relates to the tile supporting grid system art, and more specifically to tile supporting grid systems of the type having main T members arranged in spaced apart, parallel relation and cross T members extending at right angles to the main T members at predetermined spaced apart intervals, to provide a modular supporting system for tiles of standard size.

Connectors are provided, to splice the main T members, and to interlock the cross T members with each other and/or with the main T members. Such systems customarily use cross T components which are separate and different in construction from the main T components. It would be desirable to provide a single T section, usable interchangeably as either a cross T or a main T. However, a problem arises in attempting to use the same section as either a main T or a cross T, because of the need to achieve a standard 1X by 2X module, for example 24 by 48 inches, with the tile supporting flanges abutting when a pair of sections are spliced together in end to end relation, to avoid an unsightly gap. As a result it has been generally believed that the standard modules could not be achieved with interchangeable sections.

A dual purpose connector has been provided which can be used with either main T members or cross T members. However, main and cross T members of different lengths are still required to achieve a standard module.

SUMMARY OF THE INVENTION

A primary object of this invention is to provide a supporting grid system achieving a standard module with a T section which can be used interchangeably as either a main T member or as a cross T member, thereby eliminating the need to provide and stock separate and distinct cross and main T members.

Another object of this invention is to provide such an interchangeable T section with a locking connector which is operable to interlock a pair of sections in end to end relation as a main beam splice, and which also is operable to interlock a section used as a cross T in right angular relation to a section used as a main T, the connector being readily assembled to the main T section and providing an interlock between the cross T section and the main T section while the opposing cross T section is being assembled.

The foregoing and other objects, advantages and characterizing features of this invention will become clearly apparent from the ensuing detailed description of an illustrative embodiment thereof, taken together with the accompanying drawing wherein like reference characters denote like parts throughout the various views.

Figure 1:
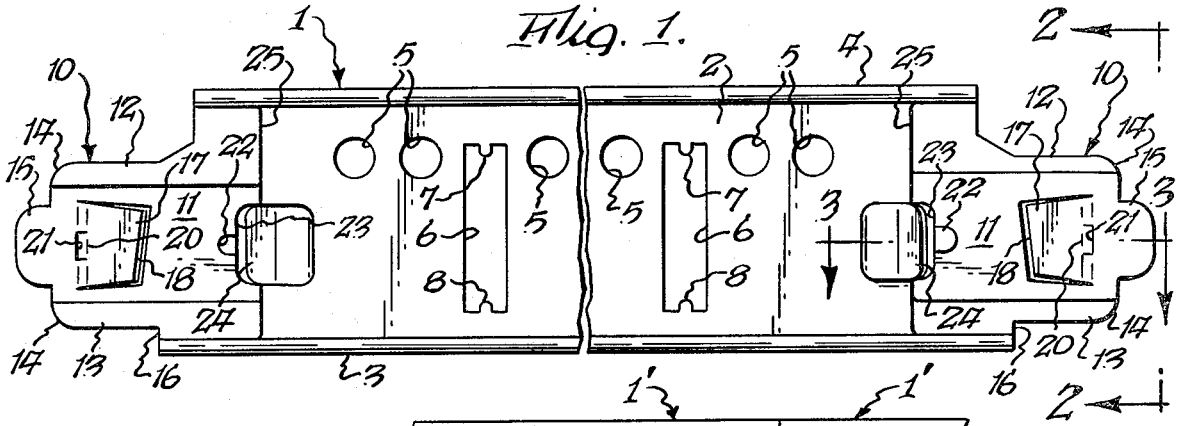
FIG. 1 is a side elevational view of an interchangeable T section of this invention, broken away in its mid-section to reduce the length thereof for ease of illustration.
Figure 2:
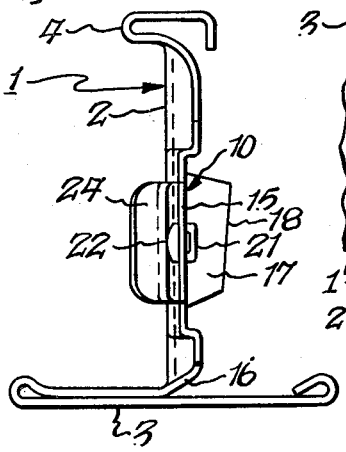
FIG. 2 is an end elevational view thereof taken about on line 2—2 of FIG. 1, on a enlarged scale.
Figure 3:
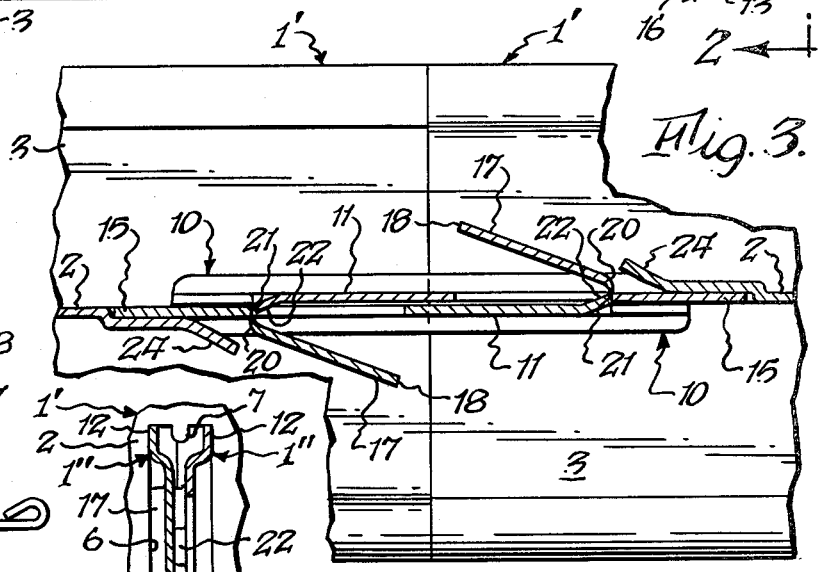
FIG. 3 is a fragmentary longitudinal sectional view thereof taken about on line 3—3 of FIG. 1, on an enlarged scale and showing a pair of sections spliced together as a main beam.
Figure 6:
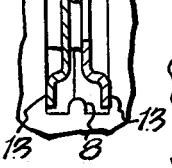
FIG. 6 is a fragmentary detail view taken about on line 6—6 of FIG. 5.
Figure 5:
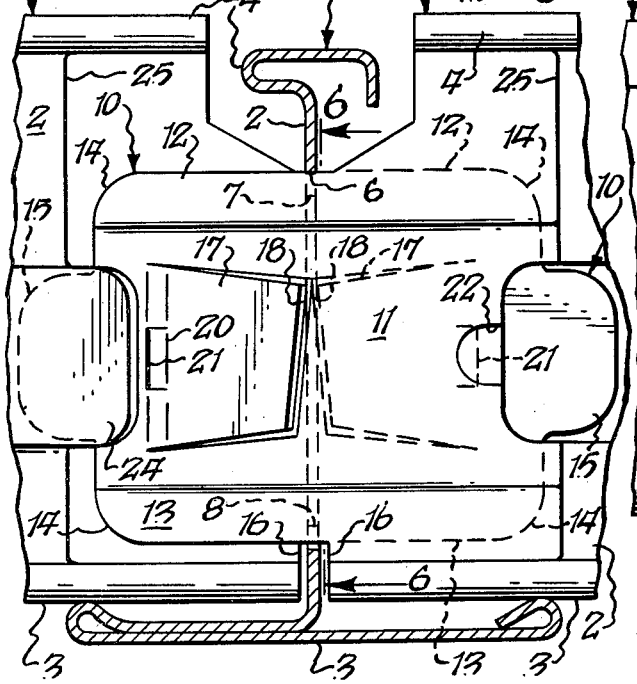
FIG. 5 is a view thereof taken about on line 5—5 of FIG. 4.
Figure 4:
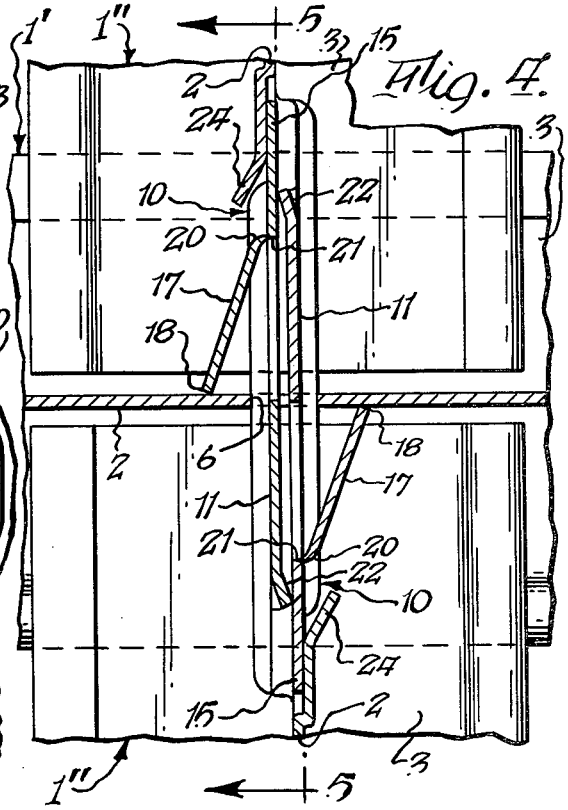
FIG. 4 is a fragmentary view thereof, on an enlarged scale, showing two of the sections shown in FIG. 1 used as cross T members joined to a third section used as a main T member.

Referring now in detail to the illustrative embodiment depicted in the accompanying drawing, there is shown in FIG. 1 a ceiling tile supporting grid section of this invention, generally designated 1, usable interchangeably either as a main T member, as indicated at 1' in FIGS. 3, 4 and 5, or as a cross T member as indicated at 1'' in FIGS. 4 and 5. Whichever way it is used, it is the same member and can be conveniently fabricated from a single piece of any suitable material, preferably an inexpensive light weight metal such as soft steel for example. The member 1 is formed to provide a generally vertical web portion 2 upstanding from laterally projecting, tile supporting flange portions 3 on opposite sides thereof along the lower edge of the web. At its upper edge, the web of section 1 is surmounted by a generally box shaped, longitudinally extending reinforcing bead 4. The construction of web 2, flanges 3 and bead 4 are obvious from the drawing and the manner of forming the same will be readily understood by those skilled in this art, whereby further description is believed unnecessary.

At spaced intervals therealong, section 1 is provided with hanger holes 5 through the web portion 2, for receiving hanger wires to suspend the section. Web portion 4 also is provided at spaced intervals with rectangular, normally vertical slots 6 therethrough, for the reception of locking connectors as hereafter described. Slots 6 are generally H shaped, being formed with downwardly and upwardly projecting tabs 7 and 8 at the top and bottom, respectively, of the slot, the tabs serving as partitions or separators when a pair of cross T sections 1'' are assembled with a main T section 1'.

The interchangeable section 1 is provided at its opposite ends with locking connectors which are identical in construction and are formed integral therewith. Each connector, generally designated 10, includes a tongue extending axially beyond the flanges 3 at opposite ends of the section 1, and the connectors at the opposite ends of each section are slightly offset from its web 2 in opposite lateral directions. The connectors are channel shaped, comprising a recessed body 11 and opposed, longitudinally extending offset portions 12 and 13, the channel configuration mechanically reinforcing the connector and adding rigidity thereto. At their leading ends, the offset portions are rounded, as shown at 14, to facilitate insertion through a slot 6, the tongues terminating at their outer ends in a tab 15 of reduced vertical dimension, coplanar with the recessed portion 11.

Each tongue 10 is formed with a stop shoulder 16 extending downwardly from the offset portion 13 to the end of the flanges 3, being adapted with flanges 3 to abut one side of the web 2 of a section used as a main T when the connector tongue is inserted through the slot 6 of that T. A locking spring finger 17 is struck out from the recessed portion 11, in the direction of the offset of that connector from the associated web 2, and has an inclined edge 18 for engagement against the opposite side of the main T web 2, as shown for example in FIGS. 4 and 5, to interlock the cross T section with the main T section. Finger 17 can be like that disclosed in my U.S. Pat. No. 3,922,829. In striking finger 17 from the tongue web 11 a recess is formed, and the metal is folded at 20 and struck through to leave a recessed shoulder 21 adapted to engage the edge of a detent 22 struck from an opposing connector, in a manner to be described.

Detent 22 is struck from the edge of a recess 23 formed by striking out a portion 24 of the connector web 11 adjacent the fold line 25 along which the connector is offset from the web 2, the wall 24 having an out-turned end and forming a pocket which extends beyond fold line 25 into the web 2 and receives tab 15 of an opposing connector. Pocket wall 24 and detent 22 project from the same side of the connector, on the side opposite finger 17.

In use, when a pair of sections 1 are to be joined together in end to end relation, as shown in FIG. 3, the connectors 10 of the abutting sections interlock to provide a splice. As they are moved together the tabs 15 enter the pockets defined by walls 24 until shoulders 21 engage the edge of detents 22 and interlock. It will be seen that the flanges 3 abut, and that pocket walls 24 resist lateral separating movement of the connectors to maintain the interlock while permitting separation upon applying sufficient force. In this way, any number of sections 1 can be joined together in end to end relation quickly and easily to provide a main beam of the desired length. Tabs 15 are received in the offset inner ends of pocket walls 24, and each tab with its associated tongue web 11 is substantially coplaner with the web 2 of the opposing section when the connectors are interlocked in this manner.

When the sections are used as cross beams, the connectors are inserted through an appropriate slot 6, on opposite sides of the projections, 7, 8, being pushed through the slot from opposite sides of the main T section. Fingers 17 resiliently yield to permit such passage, and then spring outwardly for engagement behind the web 2 of the main T section. In this way, each cross T section is interlocked to the main T section, as seen in FIGS. 4 and 5, and remains so as the opposing cross T section is assembled to the main T. Connectors 10 permit quick and easy assembly of cross and main T sections.

It is a particular feature of this invention that the interchangeable section 1 is so designed that when a pair of sections are joined in end to end relation their flanges 3 abut to avoid an unsightly gap, and that when the sections are used as cross T members, the main T flanges are accommodated by positioning the cross T flanges 3 over the flanges 3 of the section used as the main T, whereby the 1X by 2X module sizes of conventional grid systems are maintained.

For example, to achieve a typical 24×48 inch module, section 1 will be four feet long, measured between the opposite ends of its flanges 3. Only the locking connector tongues extend beyond those end points, the reinforcing bead 4 being somewhat inwardly offset from the outer ends of the flanges. One slot 6 is spaced six inches from each of the opposite ends of the flanges, and another pair of slots (not shown) are spaced inwardly one foot from each of the end slots. To achieve a two foot by four foot module, the cross T's can be inserted through any pair of slots spaced apart two feet. Because the flanges measure four feet in length and abut when a pair of sections are spliced together, and the end slots are spaced six inches from the outer ends of the flanges, the two foot modular length is preserved. When the section is used as a cross T member, because its flange ends adjacent the connectors overlie the flanges of the main T sections to which they are connected, a four foot spacing between adjacent main T's is maintained. That would not be true if the cross T flanges simply abutted the main T flanges, because then the spacing between the main T's would be the four foot length of the cross T sections, measured along the flange, plus the width of the flanges on the main T's to which they are connected.

A center slot 6 (not shown) is provided midway along the length of section 1, for a total of five slots per section. All of the slots 6 are identical in configuration to the slots 6 shown in FIG. 1. With a two by four foot module, the center slot would not normally be used. However, if a two by two foot module were required a section 1 can be cut in half and its remaining connector inserted through the center slot of one of the cross T sections being spanned, the cut-off end simply resting on the flange of the other cross T section being spanned, the half section being parallel to the main T sections.

Therefore, with this arrangement only a single section need be provided in a sufficient number to provide the necessary main and cross T members. The only other hardware is the wall angle molding, hooks, nails and hanger wire, all known in the art and therefore not shown. The one piece, interchangeable section reduces costs, and facilitates both inventory and merchandising of the product by reducing the number of different parts required to be maintained in inventory and permitting the sections to be stored, packaged and displayed in less space and without need to distinguish between cross and main T members.

Having disclosed and described a specific embodiment of my invention, it will be appreciated that this has been done by way of illustration only, and that the scope of my invention is intended to be defined by the appended claims.

I claim:

1. A supporting grid system for suspended ceilings and the like, said system being of the type having main tee members extending in spaced-apart parallel relation and cross tee members extending at right angles to said main tee members to define a standard 1X by 2X module, said members having web portions upstanding from laterally projecting tile supporting flange portions, said system being characterized by:

(a) said main and cross tee members comprising interchangeable tee sections, whereby said sections form both said main tee members and said cross tee members and are usable as either;

(b) said interchangeable tee sections having locking connectors projecting from the web portion thereof beyond the flange portions thereof, said sections also having locking connector receiving slots through the web portion thereof at spaced locations therealong, said locking connectors being engageable with each other to join a pair of said sections in end to end relation, said locking connectors extending through one of said slots of a section used as a main tee member to join a pair of sections used as cross tee members in right angular relation to such main tee sections; and (c) the flange portions of said sections substantially abutting when said sections are joined in end to end relation, and the flange portions of said cross tee sections overlying the flange portions of said main tee section.

2. A supporting grid system as set forth in claim 1, wherein said locking connectors have means engageable with said web portion for interlocking engagement for each section used as a cross tee member with the section used as a main tee member, and means interlocking said connectors together to provide a splice when a pair of sections are joined in end to end relation.

3. A supporting grid system as set forth in claim 2, wherein said web engaging means comprises a resiliently yieldable finger for slip fit passage through a slot and snap fit engagement of a section used as a cross tee member with a section used as a main tee member.

4. A supporting grid system as set forth in claim 2, wherein said last named means comprise a recessed shoulder and a laterally projecting detent spaced therefrom for interlocking engagement with the corresponding and oppositely facing detent and shoulder of the other connector.

* * * * *